United States Patent [19]

Baier

[11] 4,106,692

[45] Aug. 15, 1978

[54] HEATING SYSTEM WITH RESERVE THERMAL STORAGE CAPACITY

[76] Inventor: John F. Baier, 9 E. 40th St., New York, N.Y. 10016

[21] Appl. No.: 763,428

[22] Filed: Jan. 28, 1977

[51] Int. Cl.[2] ..... F24D 3/02; F24D 3/08

[52] U.S. Cl. ..... 237/8 R; 126/400; 237/63

[58] Field of Search ..... 126/400; 237/8 R, 19, 237/59, 63; 122/33

[56] References Cited

U.S. PATENT DOCUMENTS

| | | | |
|---|---|---|---|
| 1,560,528 | 11/1925 | Baum | 237/8 R X |
| 2,399,985 | 5/1946 | Chandler | 237/8 R |
| 2,519,266 | 8/1950 | Main | 237/8 R |
| 2,781,174 | 2/1957 | Smith | 237/8 R |
| 3,379,146 | 4/1968 | Sluiter | 237/8 R X |
| 3,958,755 | 5/1976 | Cleer, Jr. | 237/8 R |
| 4,037,779 | 7/1977 | Roy et al. | 237/8 R |

FOREIGN PATENT DOCUMENTS

| | | | |
|---|---|---|---|
| 1,289,542 | 9/1972 | United Kingdom | 237/19 |

*Primary Examiner*—William E. Wayner
*Assistant Examiner*—William E. Tapolcai, Jr.
*Attorney, Agent, or Firm*—Ostrolenk, Faber, Gerb & Soffen

[57] ABSTRACT

A space heating system having a low inertia (low mass and low water content) boiler and a larger heated water storage tank providing a bank of hot water (hereafter called the heat bank) and a "fly-wheel" effect. This provides a thermal bank or load leveler. The temperature of the water in the tank controls "on-off" operation of the furnace of the boiler. The heat sensing means for the heated space controls only the operation of the circulator in the system. A plurality of zones with a common return may be used. The flow rate from the boiler into each of the zones is controlled to be less than the rate of flow from the boiler to the heat bank so that its stored supply of heated water may be quickly established. A domestic water heating coil may be mounted in the heat bank. The connection from the boiler to the heat bank is preferably to the top of the tank which forms the heat bank. The connections to the domestic water heating coil are also preferably at the top of the heat bank. The means for sensing the temperature of the water in the heat bank is preferably associated with the bottom area of the heat bank. In addition, the system lends itself for use with a solar heat source for supplementary heat input.

4 Claims, 8 Drawing Figures

FIG. 2
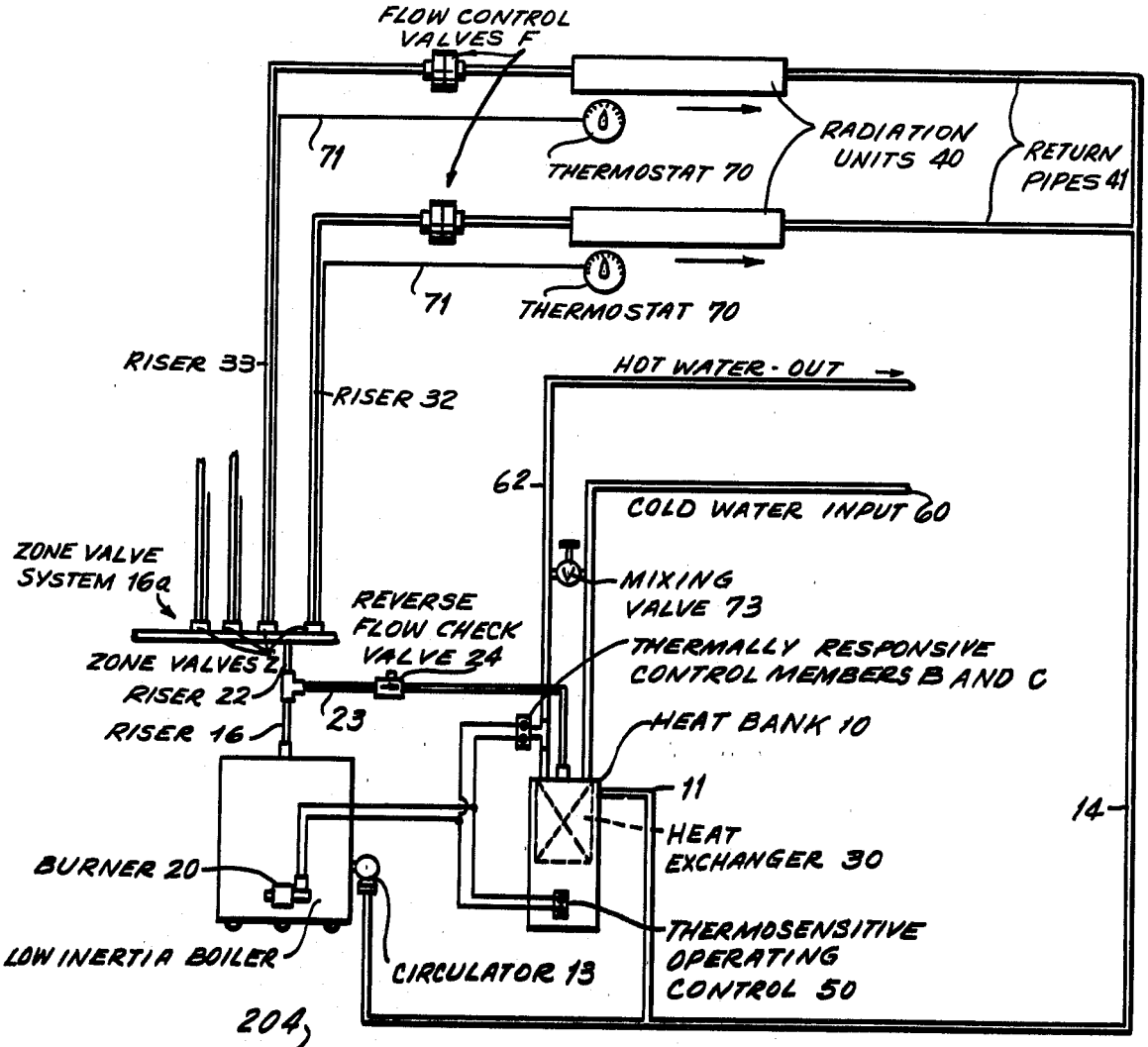
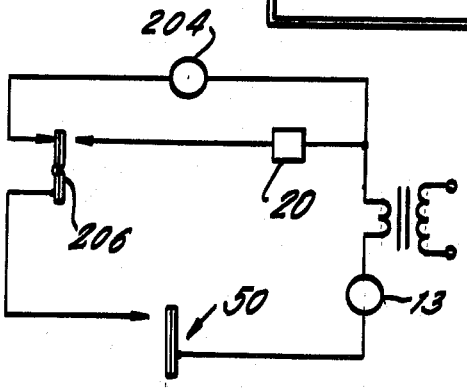
FIG. 7

HEATING SYSTEM WITH RESERVE THERMAL STORAGE CAPACITY

The present invention relates to heating systems and more particularly to heating systems using a heated water storage device which serves as a heat bank for heated water and which is used in addition to and in conjunction with a low inertia boiler, that is, a boiler having relatively small mass and small water content. Essentially the present invention utilizes the stored or banked heated water to work as the equivalent of a fly-wheel in the heating system to stabilize the boiler operation in relatively long operating cycles despite the small water content of the boiler itself.

BACKGROUND OF THE INVENTION

A large number of short cycles, occurring especially with zoned heating systems, will result in carbonizing the heat transfer surfaces of boilers; and as the heating season progresses will substantially increase the resultant output of pollutants, increase the flue temperature and reduce the boiler efficiency.

The objective of the invention is to attain 15–30% reduction in energy for providing heating and service hot water in buildings which use oil or gas as a fuel and hot water as the heating medium.

A further objective of the invention is to reduce the emittance of pollutants from such heating plants up to 90%.

The above objectives are obtained as follows:

1. By providing means to prevent short cycling of the boiler required for the heating system and to operate it with close to steady-state efficiency rather than with the much lower intermittent efficiency. This also reduces emission of pollutants which is a function of the number of firing cycles.

2. By providing means to transfer fuel energy to the heating medium in minimum space with minimum mass (low inertia), which reduces the energy required for heat-up and minimizes cool down losses.

3. Providing means to heat service domestic hot water from the same boiler which provides heating, without the necessity of maintaining boiler temperature throughout the year or without requiring a separately fired hot water heater. This reduces flue and standby losses and eliminates a separate pilot flame.

4. Providing means for efficient transfer and control of energy to the space to be heated which includes individual zone valves operated by temperature sensors, flow control valves and low water content radiators.

Automatically fired oil or gas boilers operate essentially intermittently with the number of firing cycles depending upon the boiler size, climactic conditions and temperature controls employed. While energy saving zone controls have found wide acceptance in the art, their application also contribute to a considerable increase in firing cycles and thereby offset some of their benefits. A modern zone-controlled residential hot water heating system in a 5000° day area might cycle from 20–30,000 times during a heating season and considerably more if, as is frequently the case, the boiler is oversized for the installation. Such intermittent firing reduces the boiler efficiency from 10 – 40%. With "on" cycles of less than four minutes oil burners have been found to operate at an average efficiency of only 45 – 50% as compared with their steady state efficiency of 75 – 80%.

Aside from reducing the thermal efficiency, short cycling greatly increases the output of pollutants, especially with oil firing, which in turn carbonizes the heat transfer surfaces of boilers decreasing their efficiency as the heating season progresses.

Research conducted by the National Air Pollution Control Administration has demonstrated that the most serious air pollutants from stationary sources result from fossil fuel burning boilers and furnaces; the conclusion reached is that intermittent operation of residential heating systems and many commercial systems create cyclic peaks of carbon particulate, hydrocarbon and carbon monoxide mixtures. These peaks can more than double the output of total pollutants that would result from continuous operation.

While the undesirable effects of short cycling have long been recognized in the art, so far no satisfactory remedy has been found.

Large heating installations frequently employ modulation of the firing rate of the boiler or the modular concept of step firing a number of smaller boilers to meet the fluctuating heating demand. Such systems involve complexities, are only partially effective and are not practical for residential installations.

Another approach to overcome short cycling is to considerably increase the water content of the boiler itself which will enable it to meet short heating demands without firing. Such an arrangement involves however, greatly increased flue losses and the necessity to maintain boiler water temperature throughout the heating season.

The invention resolves the problem by providing additional storage of heating water in a separate well insulated tank outside the boiler itself which is connected in parallel with the heating zones and acts as a load leveler (hereinafter called "heat bank") for the heating system. It banks heat received from the boiler which can be withdrawn by any of the heating zones on demand by the temperature operated zone valves, which in contrast to conventional systems energize only the circulator to withdraw heated water from the heat bank. When 30% of the heat has been withdrawn from the heat bank a wide differential temperature sensor in the thermal bank calls in the boiler which now replenishes the withdrawn heat from the heat bank and simultaneously supplies the heating system itself. In this manner, long operating cycles with steady state efficiency are obtained for the boiler.

By reducing the short cycling of boilers to less then one tenth that of conventional systems, the present invention, in addition to increasing the efficiency of the operation, will thus reduce air pollution to leass than ten percent of the conventional system.

BRIEF DESCRIPTION AND OBJECTS OF THE PRESENT INVENTION

The present invention contemplates the utilization of a heat bank which is preferably closely coupled with a low inertia hot water boiler employing a low water content and high capacity heat exchanger. By closely coupling the boiler with the heat bank and locating the circulating lines under a common well insulated housing, the standby losses of the complete device can be kept below one percent of the boiler input.

The heat bank of the novel system of the present invention is thus a non-fired low pressure insulated storage tank directly connected to the heating system which may store (for residential purposes) 20 to 30 gallons of water at approximately 200° F and correspondingly larger amounts for commercial installations. This stored or banked heat is transferred either to the heating system by mixing it with the return water or through a high performance built in copper heat exchanger to the domestic water circuit. When approximately 30 percent of the stored heat has been withdrawn the boiler will be operated until all heat withdrawn from the heat bank has been replenished. In this way long operating cycles with maximum efficiency are obtained for the furnace in contrast with other systems where the boiler is either operated by room thermostats, or maintained at operating temperature throughout the period of service. In the system of the present invention the boiler is always operated by a control which senses the temperature of the heat bank.

By storing the heat bank eliminates wasteful short cycling and the control system thus assures boiler "on" cycles of 8 minutes or more. Further, by not maintaining the temperature of the boiler per se, rather, by utilizing the hot water from the heat bank, flue losses are greatly reduced. By using the stored heat to supply domestic hot water, separate water heaters are eliminated. This further reduces energy requirements by eliminating flue and stand-by losses as well as pilot flame losses.

With fewer firing cycles the carbonizing of heat transfer surfaces by combustion products in oil fired boilers is greatly reduced assuring maximum seasonal efficiency. The combined fuel saving will range from a minimum of ten percent when replacing gas hot water heaters to 30 percent when replacing tankless coils in oil boilers.

The heat bank may be utilized in connection with existing heating systems and requires no special controls other then those zone valves which may already be in the system; and requires no extra circulators or relief valves.

The utilization of this heat bank will also permit a reduction in boiler capacity by about ten percent because no allowance need be made for pick-up losses simply because the heated water is already stored in the heat bank. The oversizing of oil burners and of boilers with tankless coils for the purpose of meeting hot water requirements is no longer necessary. By storing only inert boiler water under 30 pounds maximum pressure, corrosion problems and the need for 100 pound ASME constructed tanks are avoided. By eliminating the firing equipment of the conventional water heater for domestic water, potential trouble sources are reduced. In the event of a temporary furnace breakdown, all the heat stored in the heat bank can be transferred to the heating system assuring the home owner of extended freeze-up protection.

The primary object of the present invention is the provision of an additional high inertia heat storage container or heat bank for a heating system, in addition to the boiler, wherein the heated water to be provided for a heating system will be drawn from the heat bank or in combination from the heat bank and the boiler and wherein the operation of the system will be responsive only to the temperature condition of the water in the heat bank rather than to the space heating requirements.

In the usual hot water heating system the space temperature condition signals the operation of the circulator and of the boiler in order to provide sufficient heated water to meet the heating demand. Consequently, the furnace is turned off and on at very frequent intervals; in a normal heating system, this may result in more than 20,000 firing cycles in a season.

A further object of the present invention, therefore, is the arrangement of the heating system so that the heat sensors in any particular areas will signal the operation of the circulator which draws water from the heat bank which thus acts as the fly-wheel in the system. When the temperature of the water in the heat bank drops to a predetermined level then the boiler is turned on to assist in meeting the demand for space heating, and to replenish the heat loss in the heat bank.

In this simple manner, long, efficient operating cycles replace inefficient short cycles resulting from controlling the boiler directly from the space temperature sensor.

The foregoing and many other objects of the present invention will become apparent in the following description and drawings in which:

FIG. 2 is a diagrammatic view corresponding to that of FIG. 1 but showing a full heating system.

FIG. 7 is a schematic view of a circuit which may be used when a solar heater is connected as shown in the dotted lines of FIG. 1.

Figure 1:
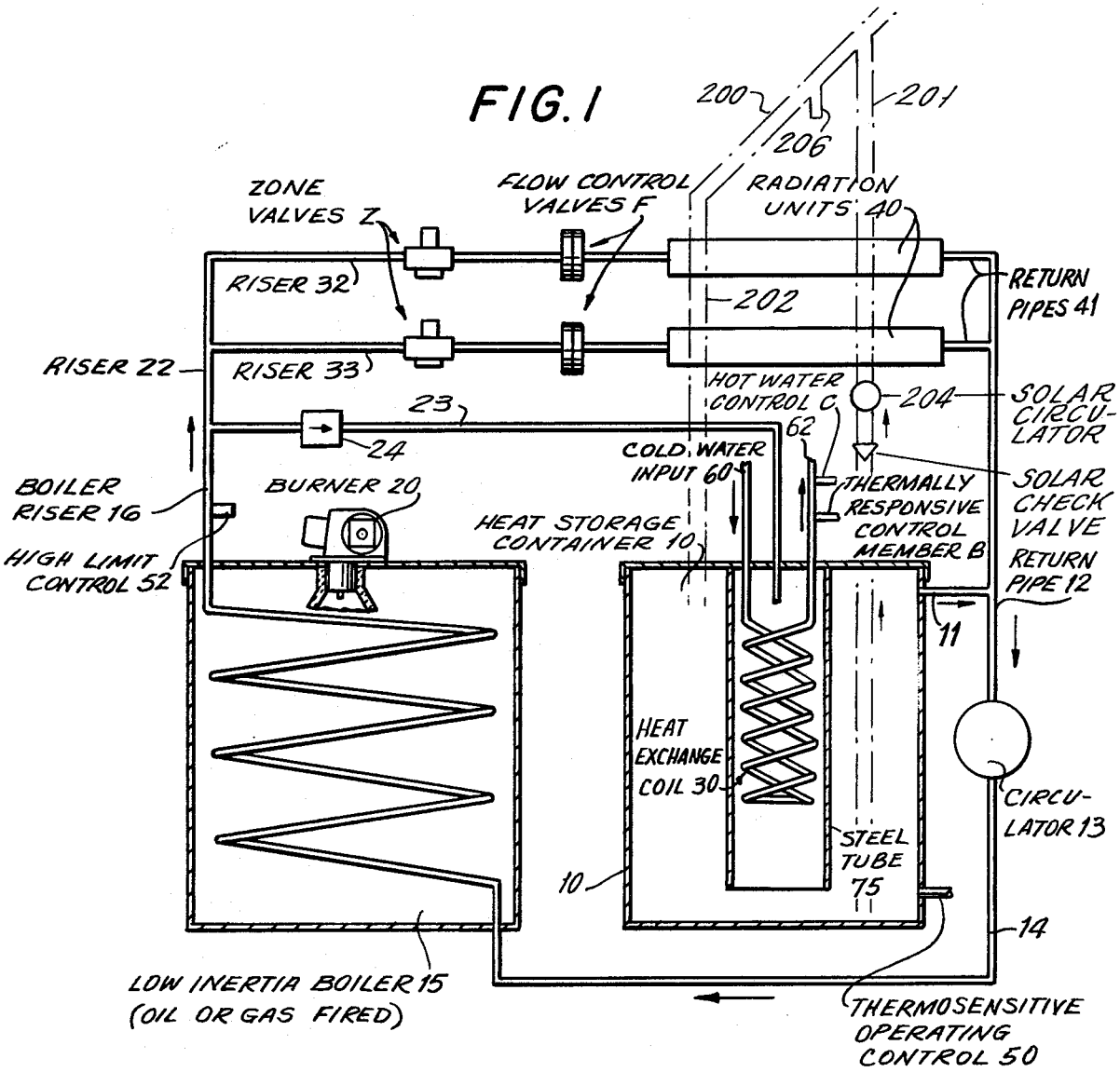
FIG. 1 is a diagrammatic view demonstrating the operation of the present invention.

Referring first to FIG. 1 which diagrammatically shows the structure of the present invention, the heat bank 10 is connected by pipe 11 to the return 12 of the heating system which in turn is connected to the circulator 13. The circulator 13 is connected by pipe 14 through the low inertia boiler 15 to the boiler riser 16. The low inertia boiler 15 may be provided with an appropriate gas or oil burner 20 and operating controls in order to heat the water in low inertia boiler 15. The water from boiler 15 in riser 16 is then divided between riser 22 for the heating system and pipe 23 leading to the heat bank 10. The relationship between the diameter of pipe 23 and flow controls F is such that the pressure drop across pipe 23 permits flow through the heating system. As an example, pipe 23 may be sized to pass 5 to 6 gallons per minute; flow control valves F may be adjusted to pass 2 to 3 gallons per minute.

The water introduced into the heat bank 10 through the conduit 23 is boiler-heated water. When the boiler is operating, the operation of circulator 13 introduces the water into the top of the heat bank 10 while at the same time providing the pressurized flow down past the hot water exchange coil 30 and its elements which will be hereinafter described.

The riser 22 is connected through the various zone valves Z to the various zone risers 32,33 and through the flow regulators F to the radiation units 40.

The operation of the circulator is primarily controlled by temperature responsive devices located in the various areas served by the various radiation devices 40. In contrast with prior systems the burner 20 and boiler 15 are not directly regulated by the temperature responsive devices associated with the radiation devices 40 or with the room or area in which they are contained. The return pipes 41 of the various zones all are connected at their output end to the return pipe 12 which as previously described is connected through the circulator 13 into the system.

The circulator 13 forces water through the boiler 15 and the pipe 23 and into the heat bank 10. If the zone valves are open, water will also be forced through riser 22 into the heating system. The burner 20 and the circulator 13 operate under the control of the thermosensitive operating control 50 located at the lower end of the heat bank 10. This control may, if desired, be exterior of heat bank 10 and in conductive contact therewith; or it may be immersed in heat bank 10. When a preselected temperature of, for instance 200° F, is reached and no room temperature sensor calls for heat, then the control 50 will open a circuit as hereinafter described to the circulator 13 and the burner and control 20 to halt the operating of the burner and circulator. On heat demand from any area occupied by one of the radiation units 40 the corresponding zone valve Z and the circulator 13 will be energized supplying heat to that zone from stored water in the heat bank 10. When water at the lower end of the heat bank 10 drops in temperature to 170° F then the operating control 50 will close the circuit to the burner 20 and circulator 13 which will now operate to supply heat to that particular zone or zones and to the heat bank 10 unit until the lower end of heat bank 10 again reaches 200° F. It will be noted that with the lower end of the heat bank 10 at 200° the upper end will be at a high level of the order of approximately 220° F. The control 50 is provided to turn off the burner should temperature in the boiler riser 16 exceed a predetermined limit.

For domestic hot water the cold water input enters through pipe 60 into the heating exchanger 30 immersed in the heat bank 10 and the heated water exits through the pipe 62 to provide domestic hot water. The thermally responsive control member B on the hot water line 62 will close the zone valves Z when the temperature of the output water drops below 140° (by way of example) giving priority to the domestic hot water supply. There is enough inertia in the heating system and radiation units 40 so that this may occur without noticeable decrease in space heating. Hot water control C will energize the boiler and circulator on prolonged demand for hot water before control 50 becomes operative to maintain domestic water temperature.

With average residential installation, the flow regulators F limit the water flow in each zone to the order of 2-3 gallons per minute and thereby assure that enough pump heat is available for circulation through the pipe 23 and into the heat bank 10. In this case, the rate of flow through pipe 23 can be of the order of four to six gallons per minute.

Referring now to FIG. 2 there is shown a more complete flow diagram for a residential heating system operating in accordance with the present invention. The water in the system is heated by the burner 20 and the boiler 15 and provides heated water to the boiler riser 16. The pipe 23 is provided with a reverse flow check valve 24 and introduces the hot water into the top of the heat bank 10 which holds the stored or banked supply of water as previously described. The riser 16 is connected to a zone valve system **16*a* comprising a plurality of zone valves Z each for a particular zone and individual risers 32, 33 for the various zones. The zone valves Z respond to thermal conditions in the particular zone area in a manner well known, opening or closing the zone valves in order to provide heat. As indicated, a room thermostat 70 is connected by a low voltage wire 71 to operate the particular zone valve Z for the particular zone. All of the elements of FIG. 2 have been given the same reference numbers as in FIG. 1** to indicate that the diagrammatic showings are of the same device.

A heat exchanger 30 for domestic hot water is located in the heat bank 10, as previously described in connection with FIG. 1; the intake of cold water enters through the pipe 60; the heated water exits through the pipe 62. An appropriate mixing valve 73 may be provided between pipe 60 and pipe 62 which may be adjusted as desired to mix appropriate proportions of cold water with the hot water in the pipes 62.

The leads 71 are also connected to operate the circulator 13 in response to the call for heat from the particular zone. The control member 50 responsive to temperature at the bottom of the heat bank 10 will be operated at a predetermined low temperature in order to energize the burner and circulator and thereby heat the water in the boiler when a low temperature is reached. Similarly, the thermostatically responsive device B will respond as described in connection with FIG. 1 to close zone valves Z when the domestic hot water temperature drops below the desired limit. Control C will energize burner 20 and circulator 13 of prolonged hot water demand.

Referring back to FIG. 1 the heating exchange coil 30 is so located in the heat bank 10 that it receives the hottest water through pipe 23 from boiler 15 and may even be shrouded by a steel tube 75 in order to ensure that the hot water entering into the heat bank 10 will be forced over the exchanger or coil 30 to obtain maximum heat transfer.

In FIGS. 1 and 2 the system has been illustrated diagrammatically.

Figure 3:
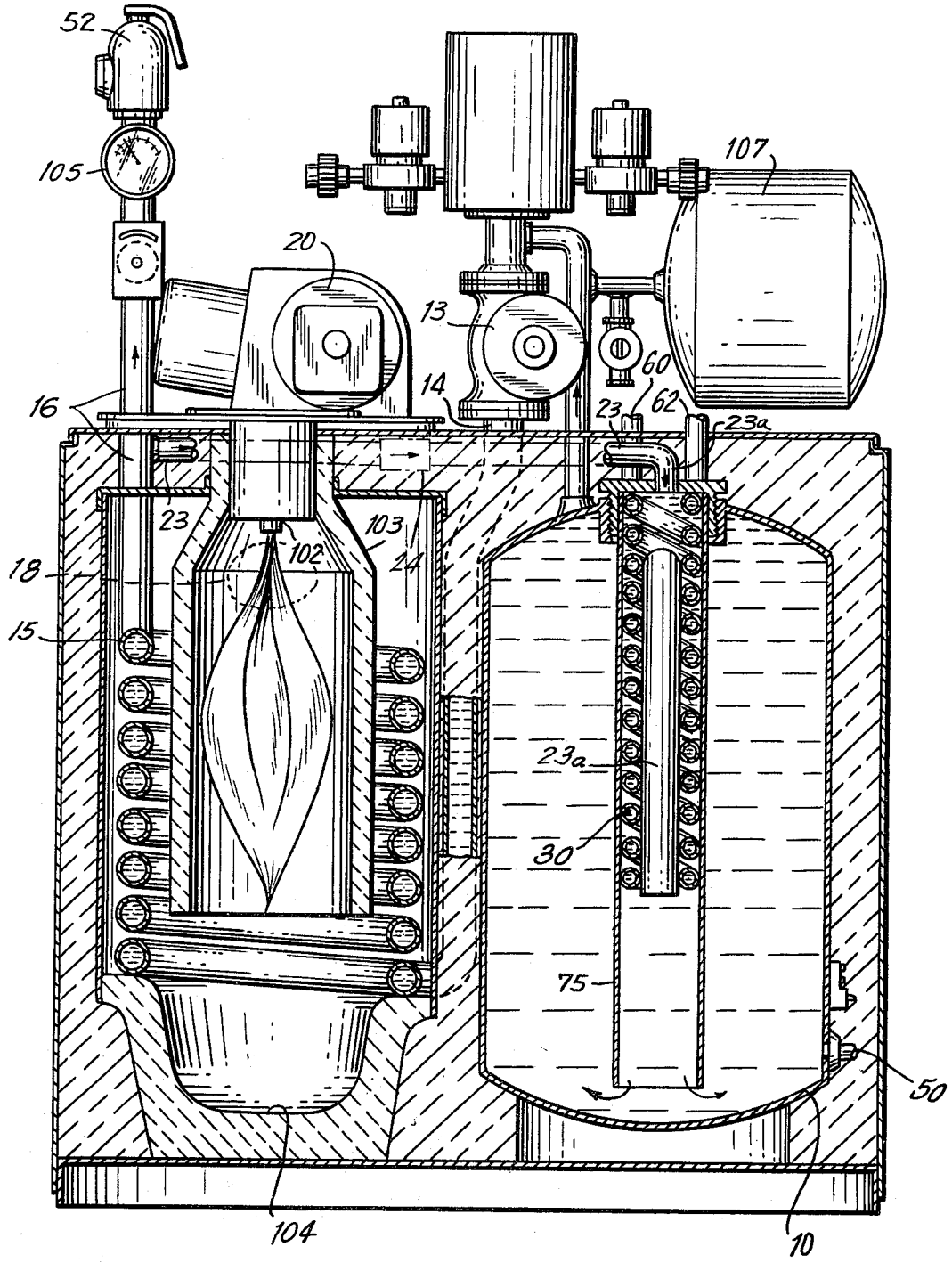
FIG. 3 is an elevation partly in vertical section of a combined furnace, boiler, a heat bank and a heat exchanger for the domestic hot water supply in a single housing and constructed in accordance with the present invention.

FIG. 3 shows one form which the basic elements of an oil fired system may take. The low inertia boiler 15 is a coil around the burner nozzle and combustion chamber 103. The burner 20 is provided with the burner nozzle 102 which ejects a stream of ignited fuel inside the combustion chamber 103. The hot combustion gases are targeted toward the ceramic deflector 104 and deflected upwardly past the coil 15, which forms the boiler to the exhaust flue 18. The boiler 15 is a low inertia boiler because it has a relatively small volume, — in this case in the form of a coil around the combustion chamber 103. The wall of the combustion chamber 103 is itself heated by the fuel so that it will impart heat to the surfaces of the turns of boiler 15 by direct radiation while the heated gases deflected from the deflector 104 will rise and also heat by conduction of coil 15. The heated gases will exhaust through flue 18.

The boiler 15 is connected to the boiler riser 16 which is thereafter connected in the manner described in connection with FIGS. 1 and 2 to the various elements of the system. The boiler riser 16 may also have connected thereto a pressure gauge 105 and the safety valve 52.

The circulator 13 is connected to the pipe 14 leading to the intake of the boiler 15 at its lower end. Pressure fluctuations may be absorbed by expansion tank 107. The output from boiler riser 16 is also connected by pipe 23 to the input at 23*a* for the heat bank 10. Check valve 24 inserted in pipe 23 prevents gravity circulation between heat bank 10 and boiler 15.

Performance of this system has been tested over extended periods in a three bedroom residence with six zone valves and baseboard heating; domestic hot water was provided by 40 gallon electric water heater and alternately by the system herein shown in which the heat bank 10 was provided with a 30 gallon storage capacity. A standard circulator 13 provided circulation through the heating system. For experimental purposes, heat bank shut off valves, arranged between the boiler and the heat bank 10 permitted the system to run in the conventional manner and, alternatively, with the heat bank 10, to afford a direct comparison of the boiler performance under essentially the same heat load.

Chart 4*a* is a recording of the boiler and circulator "on" time with one zone calling for heat at an outside temperature of 40° F; the system here used was the conventional control method where the thermostat energizes the zone valve, boiler and circulator. The heat load represents less than 10 percent of boiler capacity; the small water content boiler reached the high limit of thermostat setting of 200° on the average within two minutes while the circulator continued to run as long as the zone demanded heat.

Figure 4A:
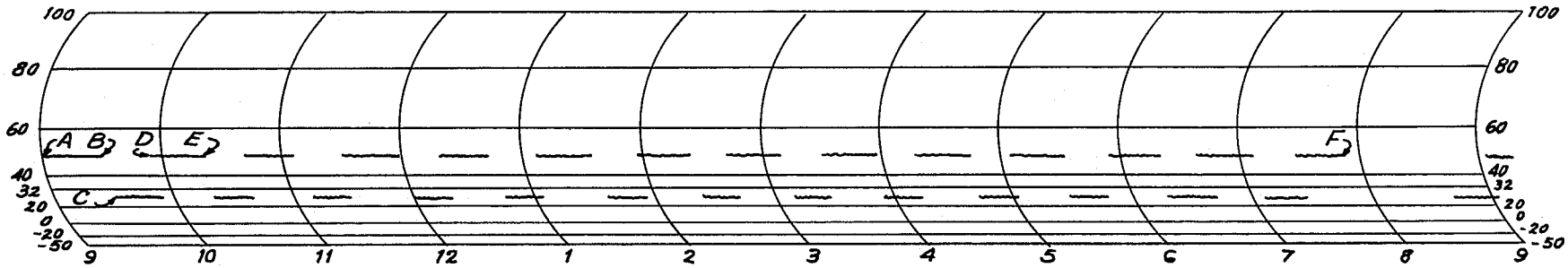
FIG. 4A PRIOR ART
FIG. 4A is a graphic recording of the cyclical operation of a boiler which does not utilize the present invention.
Figure 4B:
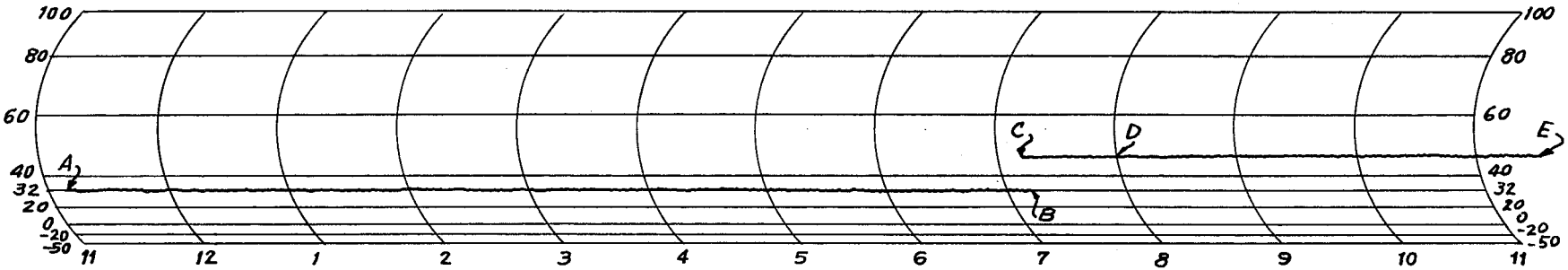
FIG. 4B is a chart corresponding to that of FIG. 4A showing the cyclical operation of a boiler utilizing the present invention.

During the test period of 62 minutes (the chart of FIG. 4*a*) the boiler cycled 15 times in an average cycle of the order of 2–3 minutes and a total "on" time of 35 minutes.

The system was then operated with the heat bank and controlled so that the room thermostat only energized the circulator; and the burner was controlled by a thermostat close to the lower edge of the heat bank 10. The heat bank thermostat was arranged with a wide differential making contact at 170° and opening at 200°. The boiler thermostat was set to open at 220°.

Chart 4*b* shows the one hour performance under these latter conditions. At the zone thermostat called for heat, the circulator was energized and withdrew heat from the heat bank 10 for 41 minutes (period A-B) reducing the heat bank 10 temperature from 200° to 170° which represents the delivery of approximately 7200 b.t.u. to the zone without firing the boiler. When the temperature in heat bank 10 reached 170°, the thermostat energized the burner at point C and caused the system to reheat. At the point marked D on chart 4*b* the zone is satisfied but the boiler continues to charge the heat bank 10 until it reaches 200° at the point marked E. Thus, the heat bank system accomplished the same heating performance with a single operating cycle of the boiler and a total "on" time of 21 minutes. This represents a fuel saving during the test period of 40 percent.

This experiment therefore indicates that under short cycling the boiler efficiency drops to 45 percent as opposed to the much higher steady state efficiency obtained with the present invention.

The heat transfer from water in the heat bank 10 to the domestic water supply is accomplished with a finned copper coil 30 of FIG. 3 shrouded by a long cylindrical tube 75 extending the full length of the tank. The circulator head is used to force the boiler water over coil 30, ensuring maximum heat transfer to the domestic hot water system.

Drawing of hot water will not cause either the boiler or its circulator to operate on draws of less than 5 to 8 gallons. Thereafter, a steep temperature drop near the bottom of the heat bank will close the thermostat 50 and will energize the burner 20 and circulator 13; the system will then operate as a forced flow heated water supply producing a prolonged supply of domestic hot water at relatively stable temperature.

Figure 5:
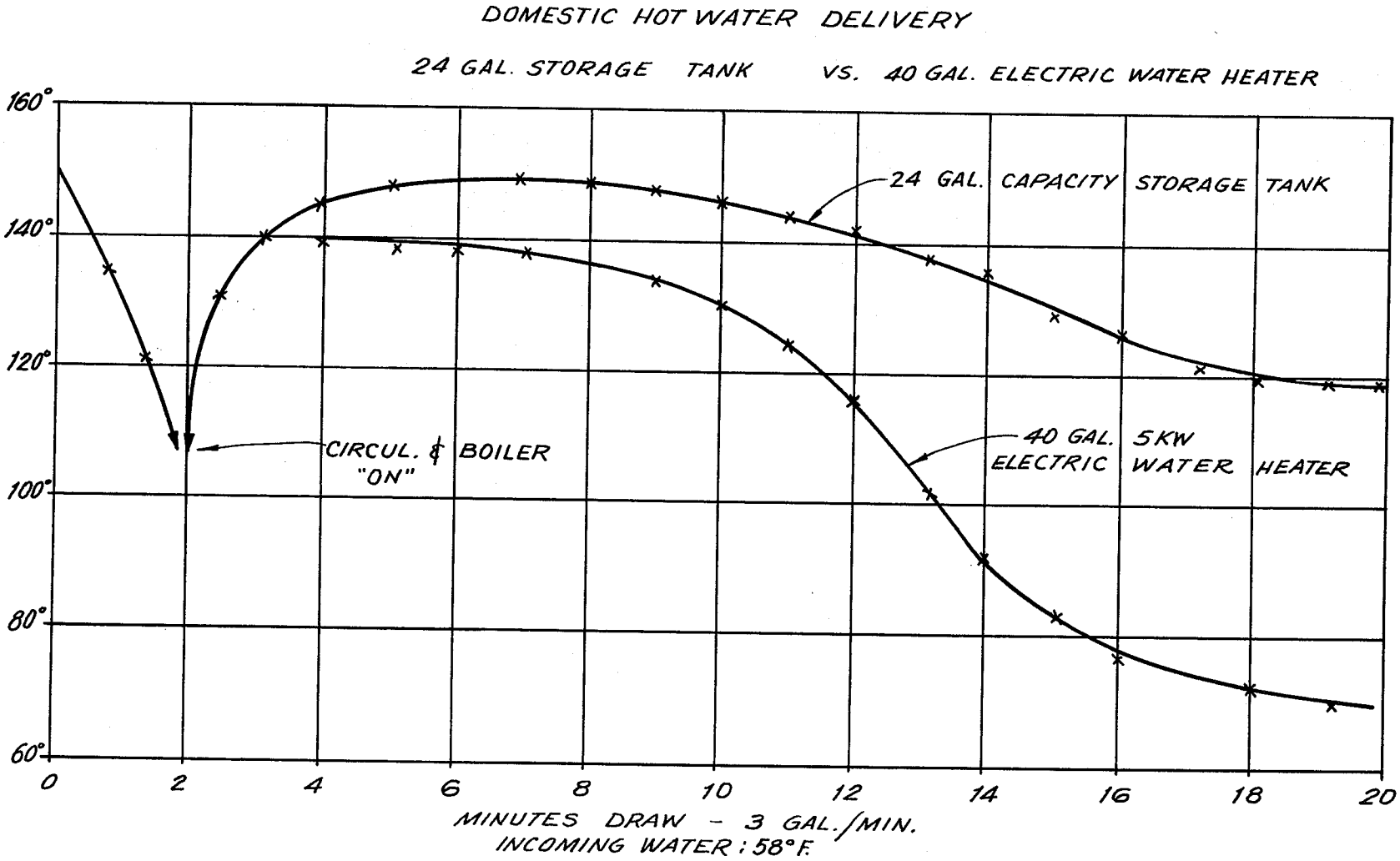
FIG. 5 is a composite graph showing the comparison of hot water delivery from a 40 gallon five kilowatt electric water heater and a small 24 gallon heat bank made in accordance with the present invention.

The operation is graphically shown in FIG. 5 which shows a comparison of hot water delivery from a 40 gallon tank, five kilowatt electric heater and a small 24 gallon heat bank.

As will be seen the heat bank delivers the first six gallons with a rapid drop in temperature from 150° to 105° (at the left side of the chart of FIG. 5) when the circulator and boiler are called in; forced heat transfer than takes place and the water temperature quickly recovers to the 150° range. The system was experimentally operated without a mixing valve which would be helpful in balancing the temperature supply but the graphic illustration of FIG. 5 shows the results utilizing the stored bank of heated water in heat bank 10 and alternatively, a separate electric heater.

Figure 6:
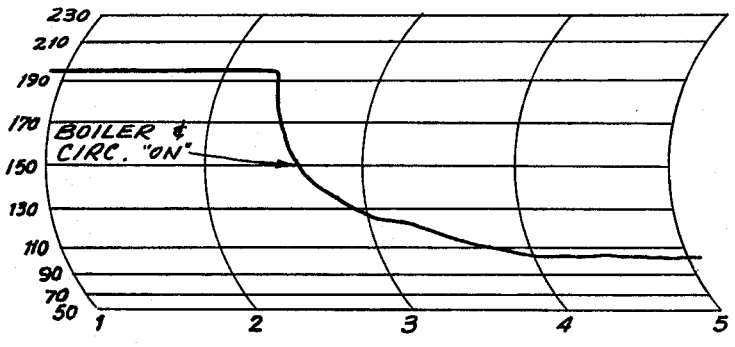
FIG. 6 is a graph showing how the drawing of domestic hot water from the system quickly reduces the bottom temperature of the heat bank and produces an "on" signal for the boiler and circulator.

The FIG. 6 chart shows how a domestic hot water draw quickly reduces the bottom temperatures of the heat bank and produces the "on" signal for the burner and the circulator. In this case the surface thermostat 50 at the lower end of the heat bank 10 closes after one minute of draw of water initially at 150° F. Within one minute, reduction of hot water output temperature to 105° will operate sensor C to energize the furnace and boiler to supply continuous heated water to the heat bank 10 until the level of output heated domestic water is restored.

While there is here shown a boiler and a heat bank which is replenished by the boiler when the temperature at the lower end of the heat bank drops to a predetermined level, the system lends itself to utilization in connection with a solar energy heat input which may be used primarily as a supplement. The input of heated water derived from solar energy into the heat bank 10 will, to the extent that it provides additional heated water for the heat bank 10, reduce the amount of energy required from the furnace and boiler and hence reduce the required firing cycles.

Therefore, as shown in the dotted line addendum to FIG. 1, a solar heater collector 200 of any desired nature may be provided having a pipe of conduit 201 extending therefrom down to and into an area adjacent the bottom of heat bank 10 and another pipe or conduit 202 extending into but adjacent the top of heat bank 10. Thus, the conduit 201 will be connected to the lower temperature area of the heat bank 10 and the conduit 202 will be connected to the higher temperature area of the heat bank 10. A solar water circulator 204 may then be provided in the conduit 201. The water in the heat bank 10 together with the water in conduits 201 and 202 and the solar heater 200, will be a continuous closed system in parallel with the closed circulating hot water system including the pipe 23 from the boiler 15 to the heat bank 10 and in parallel with the heating system.

When the sensor 50 at the lower end of heat bank 10 calls for the infusion of heated water and the sensor 206 at the solar heater is in a position to provide such heated water, then the circulator 204 will be caused to operate until the heated water in heat bank 10 is replenished as determined by the sensor 50. If, however, during operation, the sensor 206 should show a reduction in the temperature of the water in the solar heater 200, then the operation will be transferred from the circulator 204 to the circulator 13 and at the same time a signal will be transmitted to the burner 20 to fire. Sensor 206 (see also FIG. 7) is a relay which, when there is a sufficient heat level in the solar heater, will prepare a curcuit for operation of the circulator 204 in response to sensor 50. If, however, there is insufficient heated water in the solar heater 200, then the sensor 206 will open the prepared circuit to the circulator 204 and will close the circuit to the circulator 13 and the burner 20. The circulator 13 and the burner 20 of boiler 15 will thereafter operate only when the sensor 50 at the lower end of the tank 10 indicates the need for input of additional heated water into the tank 10. Therefore, when the water that is in the solar heater is at a sufficient elevated temperature, the circulator 13 and the burner 20 are cut out of the circuit which is controlled by the sensor 50. When the water at the solar heater 200 is at a lower temperature, the sensor 206 is operated so that the circulator 204 is cut out of the circuit, while the circulator 13 and burner 20 are connected to the sensor 50.

In the foregoing, the present invention has been described in connection with preferred illustrative embodiments thereof. Since many variations and modifications of the present invention should now be obvious to those skilled in the art, it is preferred that the scope of this invention be defined, not by the specific disclosures herein contained, but only by the appended claims.

The embodiments of the invention in which an exclusive privilege or property is claimed are defined as follows:

1. In a space heating system comprising:

a boiler for heating water a source of heat for said boiler a plurality of room heat exchangers in a group of zones a connection from said boiler to said room heat exchangers, means for controlling said connection from said boiler to said room heat exchangers to permit a supply of heated water to said room heat exchangers and to close said supply;

a return from said room heat exchangers;

the invention which comprises a heat bank;

said return being connected to said heat bank;

an output connection from said heat bank to said heating system;

and an input connection from said boiler to said bank, the volume of the heat bank being substantially greater than that of the boiler;

said system including a flow circulator; and a flow regulator in the circuit from the boiler to the room heat exchanger to the heat bank; the flow to the room heating system being less than the flow to the heat bank;

said heat bank providing a supply of heated water for said system while the source of heat for said boiler is turned off;

heat sensing means at each room heat exchanger connected to and controlling said circulator;

heat sensing means at said heat bank controlling the operation of said boiler heat source;

a heat exchange coil for domestic hot water carried in said heat bank;

the connection from said boiler to said heat bank being at the top of said heat bank and the input and output connections for the heat exchange coil being at the top of said heat bank;

a vertical shroud within said heat bank surrounding said heat exchange coil; the bottom of said shroud being open and the top of said shroud receiving the input of the connection from said boiler to said heat bank.

2. The heating system of claim 1 wherein heat sensing means associated with said heat bank is connected to control the operation of said source of heat for said boiler; said heat sensing means is associated with the lower end of said heat bank;

reverse flow from the heat bank to the boiler being blocked.

3. The heating system of claim 1 including an alternate heat source, input and output connections from said alternate heat source to said heat bank;

the said input and output connections from said alternate heat source to said heat bank being in addition to the input and output connections from the remainder of the heating system to said heat bank.

4. The heating system of claim 1 wherein the frequency of firing cycles and consequent formation of pullutants is reduced as compared with a system which omits the heat bank; and reduced frequency of firing cycles permits increased fuel efficiency by providing a greater steady state operating period for each cycle.

* * * * *